US007506869B2

(12) United States Patent
Liu et al.

(10) Patent No.: US 7,506,869 B2
(45) Date of Patent: Mar. 24, 2009

(54) PAPER FEEDER

(75) Inventors: Jen-Chieh Liu, Danshuei Township, Taipei County (TW); Chun-Liang Liu, Banciao (TW)

(73) Assignee: Lite-On Technology Corporation, Taipei (TW)

( * ) Notice: Subject to any disclaimer, the term of this patent is extended or adjusted under 35 U.S.C. 154(b) by 0 days.

(21) Appl. No.: 11/889,785

(22) Filed: Aug. 16, 2007

(65) Prior Publication Data

US 2008/0088080 A1 Apr. 17, 2008

(30) Foreign Application Priority Data

Oct. 13, 2006 (TW) ..... 95218133 U

(51) Int. Cl.
*B65H 1/08* (2006.01)

(52) U.S. Cl. ..... 271/127; 271/126

(58) Field of Classification Search ..... 271/126, 271/127, 160
See application file for complete search history.

(56) References Cited

U.S. PATENT DOCUMENTS

| | | | | | |
|---|---|---|---|---|---|
| 4,582,314 | A * | 4/1986 | Yamamoto et al. | ..... | 271/127 |
| 4,585,224 | A * | 4/1986 | Kuzuya | ..... | 271/127 |
| 4,632,380 | A * | 12/1986 | Ono | ..... | 271/127 |
| 5,437,444 | A * | 8/1995 | Kawakami et al. | ..... | 271/22 |
| 6,135,443 | A * | 10/2000 | Yano | ..... | 271/121 |
| 6,158,733 | A * | 12/2000 | Muraki | ..... | 271/127 |
| 6,478,294 | B2 * | 11/2002 | Hiratani | ..... | 271/10.09 |
| 6,499,736 | B2 | 12/2002 | Hsieh | | |
| 6,824,131 | B2 * | 11/2004 | Togashi | ..... | 271/121 |

* cited by examiner

*Primary Examiner*—Kaitlin S Joerger
(74) *Attorney, Agent, or Firm*—Rosenberg, Klein & Lee

(57) ABSTRACT

A paper feeder includes a base, a roller adjacent to the base, a holder for holding a paper, and a torsional element. The holder has a pivot end and a movable end, wherein the pivot end is pivoted to the base. The torsional element is disposed at a position where the holder is pivoted to the base, and provides torsion to move the movable end of the holder to be pressed against the roller, such that a front edge of the paper is raised to be in contact with the roller. As the roller rotates, the paper is fed into a paper feed track by a frictional force.

7 Claims, 3 Drawing Sheets

PAPER FEEDER

CROSS-REFERENCE TO RELATED APPLICATIONS

This non-provisional application claims priority under 35 U.S.C. § 119(a) on Patent Application No(s). 095218133 filed in Taiwan, R.O.C. on Oct. 13, 2006, the entire contents of which are hereby incorporated by reference.

BACKGROUND OF THE INVENTION

1. Field of Invention

The present invention relates to a paper feeder, and more particularly to a paper feeder that reduces the occupied space and simplifies the assembling procedure.

2. Related Art

Various types of printing and output devices, such as printers, scanners, copiers and multi-functional peripherals (MFPs), are now available in the market. In each of these devices, two rubber rollers, including a pickup roller and a feed roller, are used to pickup and feed papers. The paper is firstly picked up from a paper tray by the pickup roller, and then is fed by the feed roller to perform the prearranged task, and finally is conveyed outside the device. The power for the motion of the two rollers is provided by transmission elements, such as gear sets or a belt.

FIGS. 1 and 2 are side views of paper feeders in the prior art.

FIG. 1 is a side view of a paper feeder in the prior art having a lower roller. A feed roller 20 is disposed on one side a paper tray 12, and is connected to a pickup roller 10 with a transmission mechanism 11. The pickup roller 10 moves downward to the paper tray 12 to be in contact with a paper 13, such that the pickup roller 10 drives the paper 13 to move to the feed roller 20 along a tangential direction of the roller. A lower roller 30 is disposed under the feed roller 20, and the lower roller 30 is in contact with the feed roller 20 appropriately. Therefore, when the paper enters, it is blocked by the lower roller 30, such that the paper 13 is rolled by the feed roller 20 to pass through the two rollers.

FIG. 2 is a side view of a paper feeder in the prior art having a lower friction plate mechanism. Here, the lower roller 30 is replaced by a lower friction plate mechanism 40. The lower friction plate mechanism 40 includes a lower friction plate 41 in contact with the feed roller 20 appropriately, and an elastic mechanism 42 combined to a bottom surface 43 of the lower friction plate 41, so as to provide an elastic force perpendicular to a tangential direction of rolling.

The two types of paper feeders described above are disadvantageous in terms of the design cost and the lifetime. Therefore, Taiwan Patent No. 500,061 entitled "Paper Separation Device for Automatic Paper Feeding" filed on Aug. 21, 2002 adds an elastic element on one side of the friction plate, so as to provide an elastic force opposite to the tangential direction of the feed roller, such that the friction plate moves along a direction opposite to the tangential direction. Thus, the lifetime of the friction plate is increased, and the cost is reduced.

According to the solutions provided in the prior art or Taiwan Patent No. 500,061, a roller set including two or more rollers is required, or a friction plate mechanism has to be added to pickup, feed, and separate papers. Therefore, the shortcomings of the mechanism include the components are too complicated to assemble difficulty, and the components occupy too much space, to cause the mechanism is not light and thin enough. In addition, the elastic element described in Taiwan Patent No. 500,061 must provide an opposite elastic force according to the acting force of the feed roller. As the elastic element outputs the force linearly, the force output is influenced by the compression amount, while the compression force is easily influenced by the tolerance in assembling. Therefore, the design problem that the elastic force output is difficult to control will occur.

Furthermore, U.S. Pat. No. 6,499,736 entitled "Paper Feeder for Papers with Different Thickness" filed on Dec. 31, 2002 disclosed that a roller device is used to perform the pickup motion, and a torsional spring sliding in a sliding slot is used to provide driving forces to pick up papers with different thickness.

Though U.S. Pat. No. 6,499,736 simplifies the roller set to a single roller, but the torsional spring is similar to the elastic element of Taiwan Patent No. 500, 061, the torsional spring is still disposed under the roller. Though the assembling procedure is simplified slightly, but the space that the assembled device occupies is not reduced, which does not satisfy the market requirements of being slight, thin, and simple in design, and is not helpful to improve the competitiveness and convenience of the product.

SUMMARY OF THE INVENTION

In the prior art, a roller set comprising a plurality of rollers is required to pickup and feed papers, and an elastic element providing the elastic force is disposed under the roller set. Therefore, the assembling is complicated, and the assembled components occupy too much space.

In view of the above problems, the present invention provides a paper feeder, which eliminates the limitations or disadvantages in the prior art that the components are too complicated and difficult to assemble, and that the assembled components occupy too much space.

The present invention relates to a paper feeder, which comprises a base, a roller, a holder, and a torsional element. The roller is disposed adjacent to the base. The holder has a pivot end and a movable end, and is used to hold at least a paper, wherein the pivot end is pivoted to the base. The torsional element is disposed at a position where the holder is pivoted to the base, and provides torsion to move the movable end of the holder to be pressed against the roller, such that a front edge of the paper is raised to be in contact with the roller. As the roller rotates, the paper is fed into a paper feed track by a frictional force.

The effect of the present invention is simplifying the assembling procedure of the paper feeder, reducing the required space, and improving the lifetime.

The paper feeder only comprises a base, a roller, a holder, and a torsional element only, so the complexity in assembling and the time for assembling is reduced significantly. Moreover, as the torsion output of the torsional element does not change much, even if the assembly tolerance occurs in the assembling, the torsion output of the torsional element is still controllable. Thus, the stability of picking up and feeding the paper for the paper feeder is improved.

Furthermore, an accommodation portion is recessed on the base to accommodate the holder and the torsional element, and the accommodation space of the accommodation portion allows the holder to swing inside but not to be exposed outside the accommodation portion. Thus, the volume of the assembled paper feeder is reduced significantly, which satisfies the requirements of being light and simple in the design.

In addition, the holder is fabricated with a plastic flat plate. Thus, the material cost of the holder is reduced, and the weight is low. Moreover, the movable end of the holder is covered by a metal sheet, so the frictional force between the roller and the holder is reduced when there is no paper, which prevents additional abrasion loss of the roller, and increases the lifetime of the roller. When the roller picks up and feeds the paper, the frictional force between the paper and the holder is also reduced, such that the roller drives the paper smoothly.

Detailed features and advantages of the present invention are described in the embodiments below, and their content is adequate for those skilled in the art to understand the technical content of the present invention and to implement the present invention. According to the content disclosed in the specification, the claims, and the drawings, those skilled in the art can easily understand the objects and advantages of the present invention.

The description on the content of the present invention above and the description on the embodiments below are used to exemplify and explain the principle of the present invention, and provide further explanation on the claims of the present invention.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

To make the object, structure, features and function of the present invention more understandable, the present invention is illustrated below in detail with reference to the embodiments.

The paper feeder according to the disclosure of the present invention is applicable to devices with paper pickup and feed functions, such as faxes, printers, copiers, multi-functional peripherals (MFP), or scanners. In the detailed illustration of the present invention below, an MFP is used as a preferred embodiment of the present invention. However, the accompanying drawings are for reference and illustration only, but not intended to limit the present invention.

Figure 1:
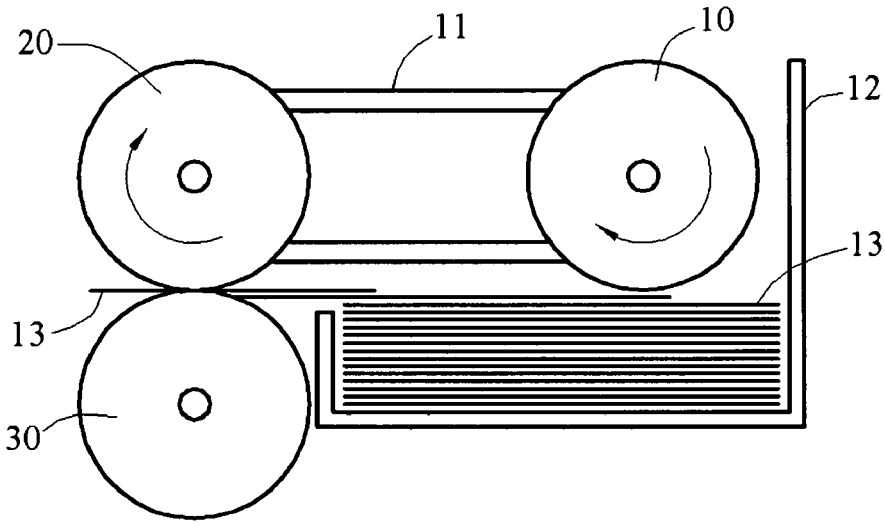
FIG.1 (PRIOR ART)
FIG. 1 is a side view of a paper feeder in the prior art having a lower roller.
Figure 2:
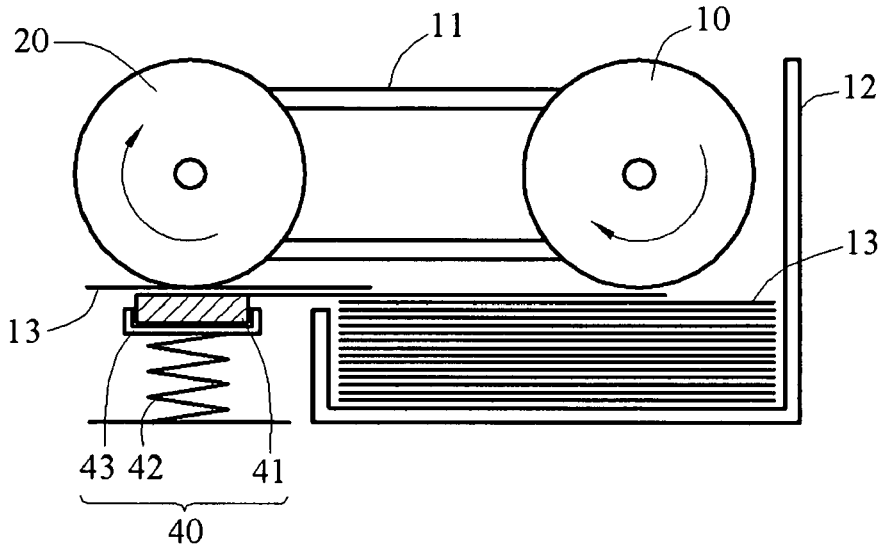
FIG.2 (PRIOR ART)
FIG. 2 is a side view of a paper feeder in the prior art having a lower friction plate mechanism.
Figure 3:
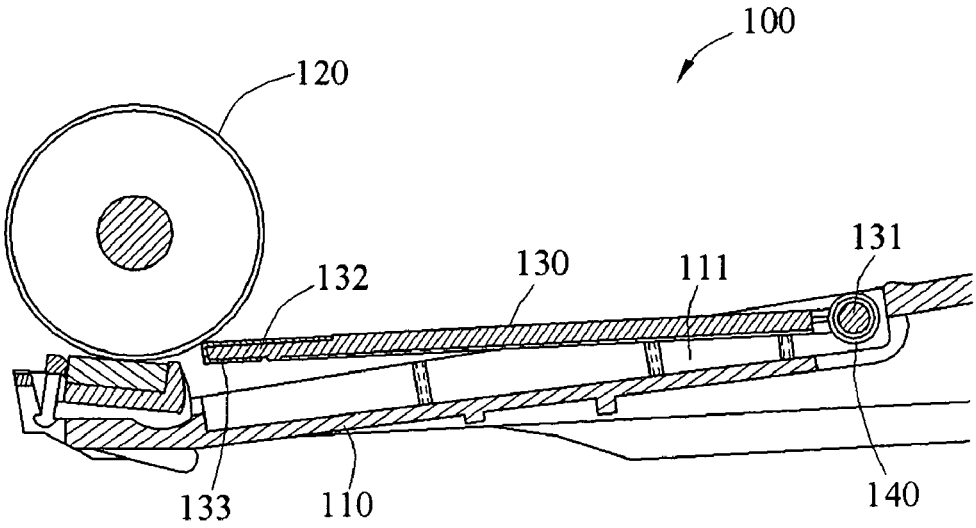
FIG. 3 is a sectional side view of the present invention.

Referring to FIG. 3, a paper feeder 100 according to an embodiment of the present invention includes a base 110, a roller 120, a holder 130, and a torsional element 140.

The base 110 is disposed at an inlet of a paper feed track of the MFP. The roller 120 is disposed adjacent to the base 110, and is used to drive a paper with a frictional force, so as to pickup and feed the paper at the inlet of the paper feed track, such that the paper enters the paper feed track. The holder 130 for holding the paper is a flat plate of plastic material. The width of the plate is to the same as that of the paper, or is less than that of the paper. The holder 130 has a pivot end 131 and a movable end 132. The pivot end 131 is pivoted to the base 110, such that the holder 130 rotates relative to the base 110. The movable end 132 may be pressed against the roller 120 or move away from the roller 120 with the rotation of the holder 130. The torsional element 140 is disposed at a position where the holder 130 is pivoted to the base 110, so as to provide a torsion, such that the holder 130 is at an angle to the base 110, and the movable end 132 moves to be pressed against the roller 120. When the torsion angle of the torsional element 140 does not change much, the change in the torsion output of the torsional element 140 is also reduced. Even if a slight tolerance occurs during assembling, the tolerance has less influence on the torsion angle as compared to the influence on the compression amount of a linear elastic element such as a linear spring. Therefore, in the present invention, even if the assembly tolerance exists, the torsion output of the torsional element 140 is still controlled within a certain range, which improves the stability of picking up the paper for the paper feeder 100.

The holder 130 holding the paper raises the front edge of the paper with a forward force provided by the torsional element 140, such that the front edge of the paper is in contact with the roller 120. Moreover, as the torsion output of the torsional element 140 is not easily influenced by the assembly tolerance, the forward force for the movable end 132 of the holder 139 pressing against the roller 120 may be controlled at an appropriate value, such that an adequate frictional force exists between the roller 120 and the paper to drive the paper to move forward. Meanwhile, the forward force is not excessively great, and will not cause an over great frictional force between the paper and the holder, which prevents the crinkle or breakage of the paper.

Figure 4:
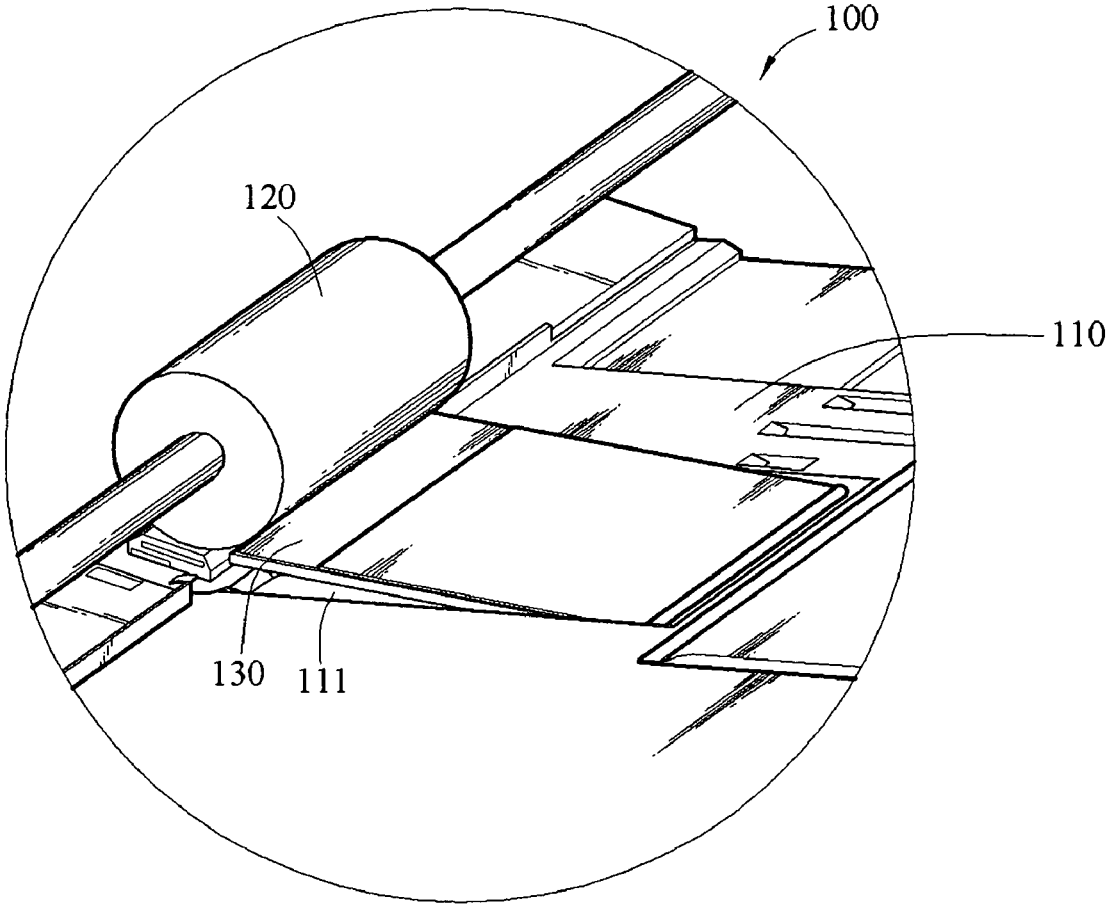
FIG. 4 is a schematic stereogram of the present invention.

As shown in FIG. 3 and FIG. 4, an accommodation portion 111 is recessed on the base 110. The accommodation space is used to accommodate the holder 130 and the torsional element 140, and the accommodation space of the accommodation portion 111 allows the holder 130 to swing inside but not to be exposed outside the accommodation portion 111. Therefore, after the base 110 is pivoted with the holder 130 and the torsional element 140, the height is not increased. Thus, the volume of the assembled paper feeder 100 is reduced. Moreover, the movable end 132 of the holder 130 is covered by a metal sheet 133 with a low frictional coefficient. When no paper is held, the metal sheet 133 lowers the frictional force between the roller 120 and the holder 130, so as to reduce the abrasion loss of the roller 120, and to improve the lifetime of the roller 120. Meanwhile, when the roller 120 picks up and feeds the paper, the metal sheet 133 reduces the frictional force between the paper and the movable end 132 of the holder 130, such that the roller 120 drives the paper smoothly, and does not cause the abrasion or crinkle of the paper.

Figure 5:
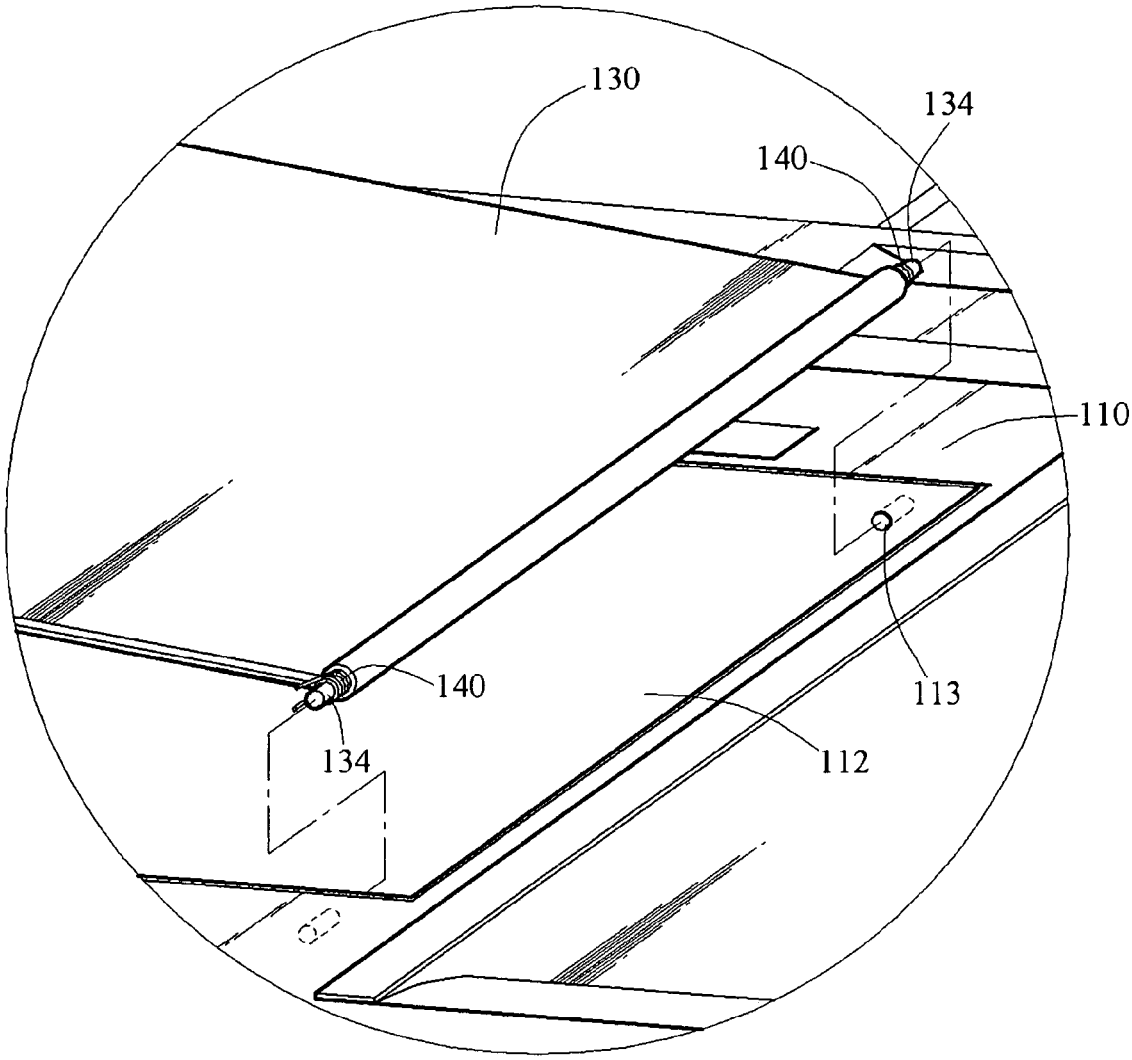
FIG. 5 is a partially enlarged schematic view of the present invention.

Referring to FIG. 5, a pivot base 112 is disposed on one side of the accommodation portion 111. The pivot base 112 has two opposite pivot holes 113, and the pivot end 131 of the holder 130 has two coaxial pivot shafts 134 extending towards opposite directions and inserted into the two pivot holes 113 respectively. Thus, the pivot end 131 of the holder 130 is completely jointed with the pivot base 112 of the accommodation portion 111. The torsional element 140 is disposed in the pivot shafts 134 of the holder 130, with an end of the torsional element 140 being connected to the holder 130, and the other end being connected to the pivot base 112, so as to provide a torsion to the holder 130.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A paper feeder, for picking up and feeding at least a paper, comprising:

a base;

a roller, adjacent to said base;

a holder having movable end and a pivot end pivoted to said base, for holding the paper; and a torsional element, disposed at the pivot end of said holder, for providing a torsion thereat to bias the movable end of said holder against said roller.

2. The paper feeder as claimed in claim 1, wherein an accommodation portion is recessed on said base, so as to accommodate said holder and said torsional element.

3. The paper feeder as claimed in claim 2, wherein a pivot base is disposed on one side of the accommodation portion and the pivot end of said holder is pivoted to the pivot base.

4. The paper feeder as claimed in claim 3, wherein the pivot base has two pivot holes, and the pivot end has two coaxial pivot shafts extending towards opposite directions and inserted into the two pivot holes respectively.

5. The paper feeder as claimed in claim 1, wherein the material of said holder is plastic.

6. The paper feeder as claimed in claim 1, wherein said holder is a flat plate.

7. The paper feeder as claimed in claim 1, wherein the movable end of said holder is covered by a metal sheet.

* * * * *